United States Patent [19]

Csemniczky et al.

[11] Patent Number: 4,492,532

[45] Date of Patent: Jan. 8, 1985

[54] SHAFT PIPE CONSTRUCTION FOR REGULATING LIQUID DELIVERY OF SUBMERSIBLE PUMPS

[75] Inventors: Janos Csemniczky; Istvan Jozsa, both of Budapest, Hungary

[73] Assignee: Ganz-Mavag Mozdony-Vagon-ës Gëpgyar, Hungary

[21] Appl. No.: 386,344

[22] Filed: Jun. 8, 1982

[30] Foreign Application Priority Data

Jun. 19, 1981 [HU] Hungary ..... 1820/81

[51] Int. Cl.[3] ..... F04B 23/02; F04D 5/00

[52] U.S. Cl. ..... 417/360; 415/53 R

[58] Field of Search ..... 417/360, 361, 424, 369, 417/370, 422, 440; 415/53 R, 58, 52

[56] References Cited

U.S. PATENT DOCUMENTS 2,933,045 4/1960 Isserlis ..... 415/53

2,994,275 8/1961 Stepnica ..... 415/53

3,708,239 1/1973 Stahle ..... 417/171

3,856,429 12/1974 Pettersson ..... 415/53 R

*Primary Examiner*—Richard E. Gluck

*Assistant Examiner*—Peter M. Cuomo

*Attorney, Agent, or Firm*—McGlew & Tuttle

[57] ABSTRACT

The invention relates to a shaft pipe construction surrounding submersible pump, for the regulation of liquid delivery.

The essence of the invention is that the lower part of the shaft pipe is constructed as a spinning spiral case connected to the upper shaft space filled with pumped liquid by return chamber comprising regulating choke-element. Main advantages of the invention are that pump station with continuously and energetically economical regulation can be established by using the commercially available submersible pumps, further, simplicity and operational safety.

5 Claims, 7 Drawing Figures

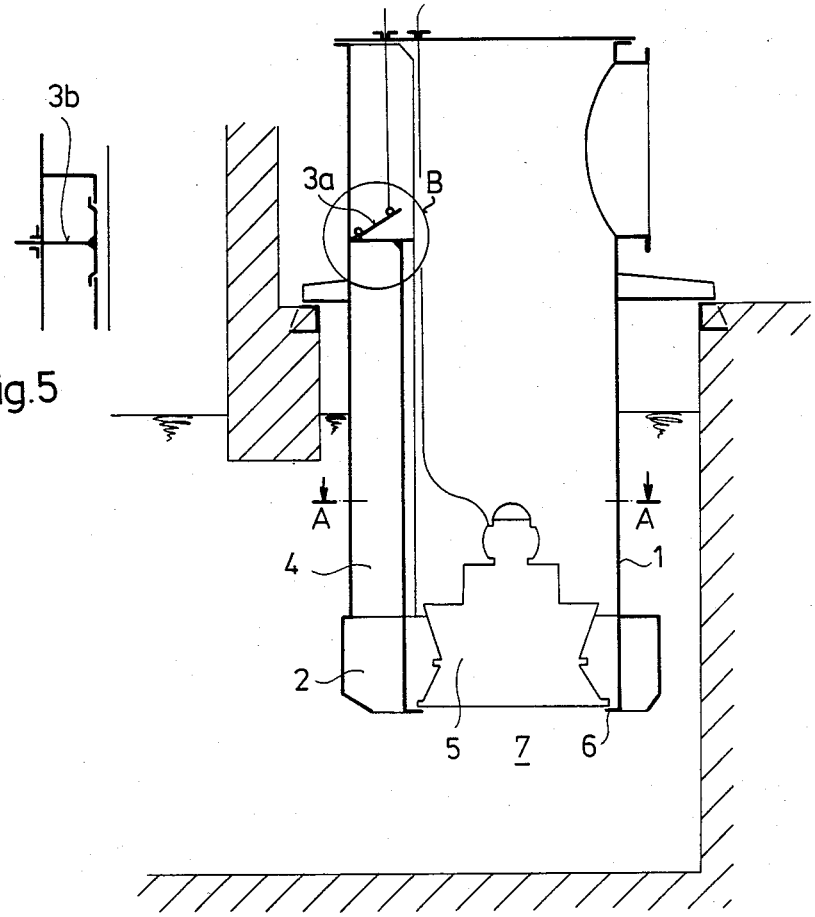
Fig.5
Fig. 3
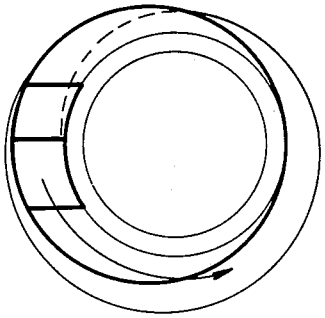
Fig. 4

SHAFT PIPE CONSTRUCTION FOR REGULATING LIQUID DELIVERY OF SUBMERSIBLE PUMPS

The invention relates in general to pumps and in particular to a new and useful new shaft pipe construction for submersible pump stations, by which liquid delivery can advantageously be regulated.

Such submersible pumps are applied first of all for pumping large quantities of raw water; for agricultural irrigation, drainage, floodwater drainage, and in industry for technological water and cooling water supplies, with liquid delivery variable within wide limits. A great advantage of submersible pumps is their simple installation, assembly and disassembly, due to the properly constructed compact pump unit and the so called shaft pipe or shaft tube. The submersible pump is lowered in the shaft pipe in which the pump unit bears up on the lower flange of the shaft pipe or tube serving for such purpose. Submersible pumps /i.e. pump stations/ and relevant shaft pipes are described in the latest issue "FLYGT submersible pumps all over the world, 1981/82, especially on pages 32 and 33 (this issue was published in 1981 by the Swedish firm).

There are methods known for the relation of the liquid delivery of pumps or pump stations, which is variable between wide limits, such as: machine-change, blade setting of the impeller, adjustable pre-guide blading, speed control of the driving electromotor, and bypass regulation. The Hungarian specification No. 168,031 describes the so called pre-spinning or prerotational bypass regulation of a system comprising turbine pump of high speed and the relavant suction and delivery duct.

A considerable disadvantage of submersible pumps mounted in shaft pipes or tubes is that they show little adaptability to the change of requirements in water supply. Machine-change does not facilitate infinite control, in addition, it involves huge investment costs. Blade setting of the impeller, i.e. adjustable pre-spinning or prerotation blading would considerably complicate the construction and would decrease reliability by its sensitive structural elements. Speed control in solving these tasks is hydraulically disadntageous, as considerable decrease of the delivery head implies only a slight decrease of water delivery and this is in contradiction with the requirements.

There is a further disadvantage, namely that very expensive electrical devices are needed for speed control. A disadvantage of control by bleeding or bypass is that an energy loss proportionate to the recirculated volume incurs. Though prerotational control by bleeding is advantageous from the viewpoint of both energy saving, investment costs and operational safety, for the sake of the advantages of the known solutions /e.g. according to the patent specification No. 168.031/, the considerable advantages resulting from the compact character of submersible pumps is their simple installation and the construction requiring few connections; and not requiring suction and delivery ducts at all, would have to be given up.

SUMMARY OF THE INVENTION

The invention facilitates the application of prerotational regulation in submersible pump stations. The invention provides a construction such that the shaft tubes of the submersible pump stations provide prerotational regulation without changing the compact, original construction of the pump station.

The invention is based on the recognition that by a minor completion, i.e. transformation of the traditional shaft tubes, however, without suction and delivery tube, one part of the liquid which is in the shaft pipe is recirculated before the submersible pump, to facilitate a spiral flow favourable from the viewpoint of regulation. On the basis of this recognition the submersible pump unit may remain unchanged and the advantages of assembly and disassembly may also remain the same.

The simplest mode of prerotating regulation of liquid delivery of the submersible pump is that the liquid is recirculated before the submersible pump through the spirally constructed bottom part of the shaft tube. This spiral case is connected—by a so called return chamber compirising a choke or throttle element—to the upper space of the shaft tube filled by the liquid delivered by the submersible pump.

The invention and some embodiments to be applied favourably are described herebelow by way of drawings, where FIG. 1 is a sectional view of a shaft tube constructed according to the invention, with the submersible pump arranged in it concentrically and showing the principle of recirculation, FIG. 2 is a section taken along the A-A of the shaft pipe according to FIG. 1, the arrow indicating the flow of the recirculated liquid;

FIG. 3 is a view similar to FIG. 1 of an embodiment of the return chamber and of the throttle-element arranged inside the shaft tube, with the pump arranged eccentrically;

FIG. 4 is a section taken along the line A-A of the shaft tube according to FIG. 3, the arrow indicating the flow of the recirculated liquid;

FIG. 5 is a partial sectional view of the return chamber indicated on FIG. 3, with another embodiment of the throttle-element;

Figure 1:
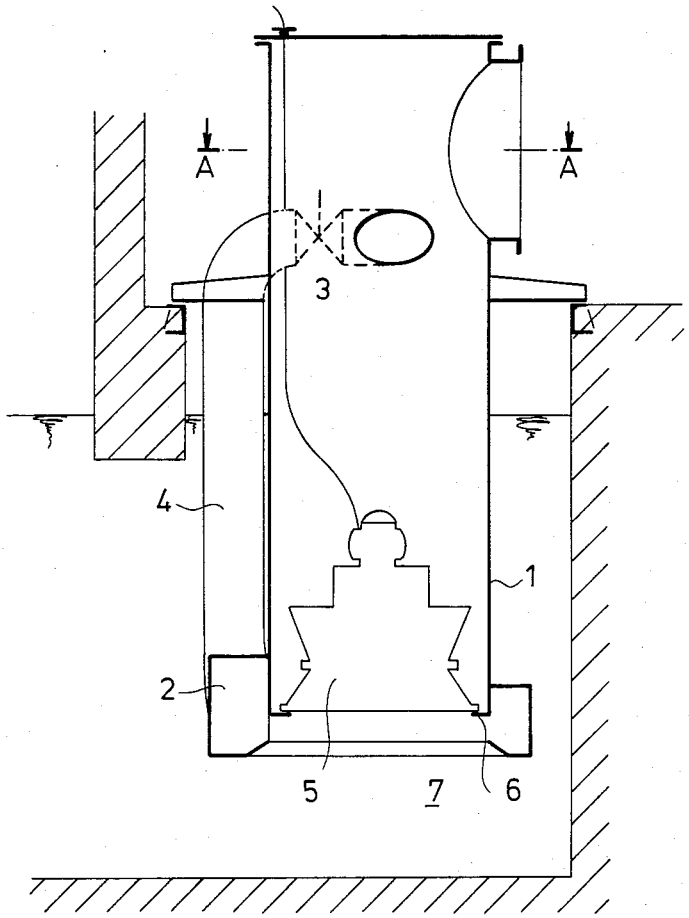
Figure 6:
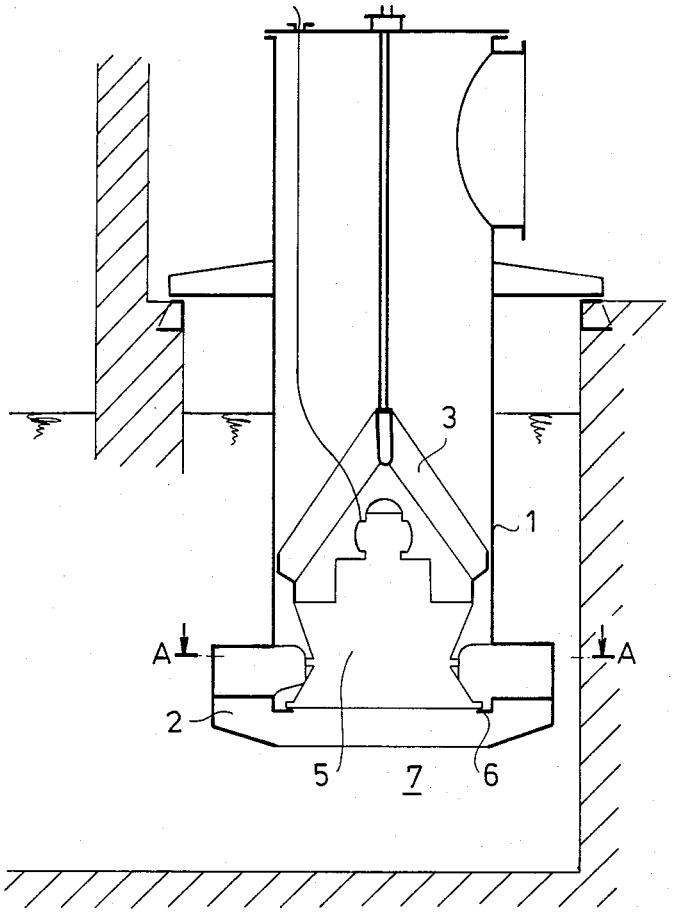
FIG. 6 is a view similar to FIG. 1 of an embodiment which shows the pump arranged concentrically in the shaft tube, with double-thread spiral case arranged at the end of the shaft tube, showing recirculation regulated by a cylindrical slide valve.

As it can be seen on FIGS. 1, 3 and 6, shaft tube 1 is mounted in pump shaft or liquid space 7 vertically, by proper connecting elements. A one- or double-thread prerotation spiral case 2 is connected to shaft tube 1 in the bottom thereof. A submersible pump 5 is arranged in the shaft tube 1 concentrically /FIGS. 1 and 6/ or eccentrically /FIG. 3/ bearing up on flange 6 serving for this purpose. The submersible pump 5 sucks the liquid from liquid space 7 from which a partial volume, to be set by means of a throttle-element 3, is recirculated into the prerotation spiral case 2 through a return chamber 4.

Liquid may be delivered from the shaft tube 1 directly, axially, through the end piece of the shaft tube or the shaft tube may have a bend to which an auxiliary delivery pipe may be connected, if required.

Figure 2:
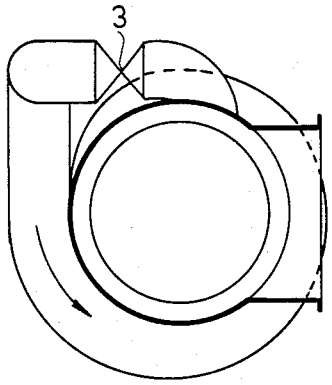

As shown on FIGS. 1 and 2, from the shaft tube 1 one part of the liquid delivered by the submerged pump 5 flows back to the pre-rotation spiral case 2 through return chamber 4 return chamber—by means of the throttle-element 3-. From the spiral case 2 the liquid flows out by spinning and it gets mixed with the liquid sucked from the liquid space 7. Thus a spiral flow develops before the pump impeller, decreasing the delivery head and the rate of power input, while in proportion with the recirculated liquid amount, liquid delivery also decreases. The rate of decrease may be set by means of the throttle-element 3 which may be a catch, valve, cylindrical slide valve, etc, as required.

As shown in FIGS. 3 and 4, the flange 6 supporting pump 5 is arranged eccentrically in shaft pipe 1. Return chamber 4 and choke-element 3 are also inside shaft pipe 1. In FIG. 3, the encircled portion "B" demonstrates a vertically actuated catch 3a, while FIG. 5 shows a horizontally actuated, valve-like throttle-element 36.

Figure 7:
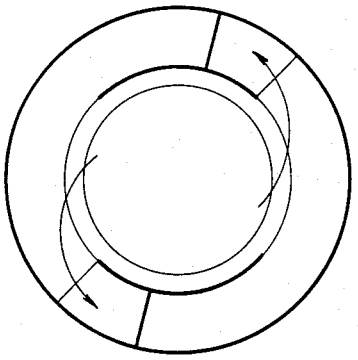
FIG. 7 is a section taken along the A-A of the double-thread spiral case indicated on FIG. 6; the arrows indicating the flow of the recirculated liquid.

According to FIGS. 6 and 7, a throttle-element 3 is constructed as a cylindrical slide valve. By moving the cylindrical slide valve upwards, the liquid flows through the gap between the upper flange of the pump casing 5 and the lower flange of the slide valve 3 into the return chamber 4 confined within the external shell of the pump casing and the shaft tube 1. The recirculated liquid flows into the pre-rotation spiral case 2 through one or two openings in the bottom part of the shaft tube. The spiral case is, accordingly, double-threaded in such case. As it can be seen from the figures referred to above, there are several embodiments to be realized according to the invention: the submersible pump itself may be arranged in the shaft tube concentrically or eccentrically; in the former case the return chamber may be arranged both outside and inside the shaft pipe. The regulating throttle-element may be of variable type as well and it may be placed inside and outside the shaft; in the former case even if the return chamber itself is arranged outside the shaft tube.

By the shaft tube construction according to the invention, simple and effective regulation of the liquid delivery of submersible pump stations could be realized. Should there be several submersible pumps applied in the pump station parallely, expediently one or several, or all shaft tubes may be constructed.

Main advantages of the invention:

by using the commercially available submersible pumps, pump stations with continuous and energetically economical control of the liquid delivery can be established;

simplicity and operational safety.

What we claim is:

1. A submersible pump system for pumping liquids, comprising:

a shaft tube having a lower inlet at a lower end thereof and adapted to have its lower inlet immersed in a liquid;

a liquid rotating case connected at the lower end of said shaft tube, having an outlet adjacent said lower inlet of said tube and an upper inlet for receiving liquid;

a submersible pump supported in said tube at the lower end of said tube, adjacent said lower inlet of said tube, said pump having an inlet adjacent said lower inlet of said tube for receiving liquid, and an upper outlet for discharging liquid into said tube;

a vertical return passage connected between said rotating case upper inlet and a portion of said shaft tube above said pump outlet; and a regulating throttle disposed in said return passage for regulating a flow of liquid from said portion of said shaft tube to said rotating case.

2. A submersible pump system according to claim 1, wherein said shaft tube has the lower end with a flange thereon extending inwardly, said pump being supported in said shaft tube on said flange, said case being symmetrically arranged in respect to said pump.

3. A submersible pump system according to claim 1, wherein at least a portion of said case extends exteriorly around said shaft tube, said return passage extending alongside one side of said shaft tube.

4. A submersible pump system according to claim 1, wherein said shaft tube has an internal flange adjacent its lower end, said submersible pump being supported on said flange, said case extending around said shaft tube adjacent said flange, said throttle comprising a vertically actuated catch, said return passage being defined exteriorly of said shaft tube.

5. A submersible pump system according to claim 1, wherein said return passage is defined within said shaft tube, said regulating throttle comprising a cylindrical slide valve moving in said shaft tube.

* * * * *